US011950658B2

(12) United States Patent
Sawada

(10) Patent No.: US 11,950,658 B2
(45) Date of Patent: Apr. 9, 2024

(54) SHOE UPPER AND METHOD FOR PRODUCING SHOE UPPER

(71) Applicant: ASICS CORPORATION, Kobe (JP)

(72) Inventor: Daisuke Sawada, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 16/959,131

(22) PCT Filed: Dec. 25, 2019

(86) PCT No.: PCT/JP2019/050861
§ 371 (c)(1),
(2) Date: Jun. 29, 2020

(87) PCT Pub. No.: WO2021/130905
PCT Pub. Date: Jul. 1, 2021

(65) Prior Publication Data

US 2021/0315317 A1 Oct. 14, 2021

(51) Int. Cl.
*A43B 3/26* (2006.01)
*A43B 23/02* (2006.01)

(52) U.S. Cl.
CPC ..... *A43B 3/26* (2013.01); *A43B 23/0235* (2013.01); *A43B 23/0245* (2013.01)

(58) Field of Classification Search
CPC ... A43B 3/26; A43B 23/0235; A43B 23/0265; A43B 23/026; A43B 23/081; A43B 23/088; A43B 1/0081
See application file for complete search history.

(56) References Cited

U.S. PATENT DOCUMENTS 2,110,249 A * 3/1938 Walker ..... A43D 111/00 156/249
2,327,043 A * 8/1943 Hirsch ..... A43B 23/081 36/106

(Continued)

FOREIGN PATENT DOCUMENTS

JP S47-009273 A 5/1972
JP H01-103305 U 7/1989

(Continued)

OTHER PUBLICATIONS

JP2018109249 Translation via Espacenet, translated Apr. 28, 2022 (Year: 2018).*

(Continued)

*Primary Examiner* — Heather Mangine
*Assistant Examiner* — Raquel M. Weis
(74) *Attorney, Agent, or Firm* — Studebaker & Brackett PC

(57) ABSTRACT

Provided is a shoe upper that includes an upper body including a region having elasticity, and a film arranged in the region, in which the film has a heat shrinkage rate of 30% or more at least in one direction. Also provided is a method for producing a shoe upper that includes: a preparation step of preparing an upper body including a region having elasticity; an arrangement step of arranging a film in the region of the upper body, in which the film has a heat shrinkable rate of 30% or more at least in one direction; an attachment step of attaching the upper body to a shoe last or foot; and a heating step of, after the arrangement step and the attachment step, heating the upper body with the film arranged thereon to thereby allow the film to shrink to conform to the shoe last or foot.

20 Claims, 5 Drawing Sheets

(56) References Cited

U.S. PATENT DOCUMENTS 3,082,552 A * 3/1963 Ciaio ..... A43B 23/0235 36/68
3,130,505 A * 4/1964 Markevitch ..... A43B 23/0235 428/305.5
3,568,339 A * 3/1971 Hara et al. ..... A43B 1/0072 36/102
3,634,954 A * 1/1972 Larsen ..... A43B 3/163 36/72 C
3,775,793 A * 12/1973 Casavant ..... A43D 11/003 12/1 R
3,941,633 A * 3/1976 Wang ..... D06N 3/0095 428/318.6
5,265,349 A * 11/1993 Munschy ..... A43B 3/26 36/105
5,647,150 A * 7/1997 Romanato ..... A43B 5/0482 12/142 R
5,893,222 A * 4/1999 Donnelly ..... A43B 5/0405 36/117.6
6,237,251 B1 * 5/2001 Litchfield ..... A43B 3/34 36/31
6,299,962 B1 * 10/2001 Davis ..... B29C 33/306 36/129
6,374,516 B1 * 4/2002 Bonaventure ..... A63C 17/0086 36/97
6,584,704 B2 * 7/2003 March ..... A43B 3/163 36/7.1 R
9,167,866 B2 * 10/2015 Neal ..... A43B 13/122
10,051,915 B2 * 8/2018 Otsuka ..... A43B 13/187
10,182,618 B2 * 1/2019 Kirk ..... A43B 1/04
2002/0012784 A1 * 1/2002 Norton ..... A43B 23/042 428/304.4
2005/0022421 A1 * 2/2005 Bruckner ..... A43B 23/081 36/11
2005/0034330 A1 * 2/2005 Baychar ..... A43B 23/07 36/55
2005/0039344 A1 * 2/2005 Berg ..... A43B 3/26 36/7.1 R
2006/0051566 A1 * 3/2006 Challe ..... A43B 23/028 428/304.4
2007/0068045 A1 * 3/2007 Condie ..... A43B 23/081 36/77 R
2007/0199210 A1 * 8/2007 Vattes ..... A43B 7/085 36/45
2009/0107012 A1 * 4/2009 Cheney ..... A43B 23/0235 36/25 R
2010/0041295 A1 * 2/2010 Malz ..... A43B 23/026 156/60
2010/0077634 A1 * 4/2010 Bell ..... A43B 23/042 112/475.08
2011/0035963 A1 * 2/2011 Baker ..... A43B 13/40 36/114
2011/0107621 A1 * 5/2011 Mordecai ..... A62B 17/003 36/47
2012/0246973 A1 * 10/2012 Dua ..... A43B 23/0255 36/83
2013/0047471 A1 * 2/2013 Liang ..... A43D 111/00 428/156
2014/0147618 A1 * 5/2014 Schmoll ..... A43B 1/0081 428/100
2015/0001199 A1 * 1/2015 Jeon ..... H05B 3/02 219/201
2015/0052778 A1 * 2/2015 Kirk ..... A43B 1/04 442/204
2015/0181975 A1 * 7/2015 Otsuka ..... A43B 13/12 36/28
2015/0230545 A1 * 8/2015 Bacino ..... A43B 7/125 36/43
2015/0237948 A1 * 8/2015 Mallen ..... A43B 1/04 66/170
2015/0282564 A1 * 10/2015 Meschter ..... A43B 23/042 12/142 R
2015/0342261 A1 * 12/2015 Boucher ..... A43B 7/1495 12/142 G
2016/0219967 A1 * 8/2016 Smith ..... F21V 33/0008
2017/0042280 A1 * 2/2017 Bacino ..... A43B 17/107
2017/0129200 A1 * 5/2017 Adami ..... A43B 1/04
2017/0311672 A1 * 11/2017 Hipp ..... A43B 23/0235
2018/0168274 A1 * 6/2018 Dickson ..... A43B 5/18
2018/0213884 A1 * 8/2018 Kim ..... A43B 13/127
2018/0368524 A1 * 12/2018 Taniguchi ..... A43B 23/0275
2019/0008234 A1 * 1/2019 Christensen ..... B29C 65/50

FOREIGN PATENT DOCUMENTS

JP 3064566 U 1/2000
JP 2001-513666 A 9/2001
JP 2010-017327 A 1/2010
JP 2010017327 A * 1/2010
JP 2015-506778 A 3/2015
JP 2018-109249 A 7/2018
JP 2018109249 * 7/2018 ..... A43B 23/02
JP 2018109249 A * 7/2018
WO 2017/115805 A1 7/2017
WO 2017/115806 A1 7/2017

OTHER PUBLICATIONS

Written Opinion of the International Searching Authority issued in PCT/JP2019/050861; dated Jul. 27, 2020.

An Office Action; "Notice of Reasons for Refusal", mailed by the Japanese Patent Office dated Jul. 9, 2021, which corresponds to Japanese Patent Application No. 2020-528981 and is related to U.S. Appl. No. 16/959,131; with English language translation.

The extended European search report issued by the European Patent Office dated Nov. 13, 2020, which corresponds to European Patent Application No. 19897568.2-1011 and is related to U.S. Appl. No. 16/959,131.

Communication pursuant to Article 94(3) EPC issued by the European Patent Office dated Mar. 31, 2022, which corresponds to European Patent Application No. 19897568.2-1005 and is related to U.S. Appl. No. 16/959,131.

* cited by examiner

SHOE UPPER AND METHOD FOR PRODUCING SHOE UPPER

FIELD

The present invention relates to a shoe upper and a method for producing the shoe upper.

BACKGROUND

The fitness of a shoe, particularly a shoe upper is one of the important factors for shoe users. A shoe that fits well to the shape of the user's foot can provide the user with a comfortable wearing feeling, is unlikely to damage the foot when in wearing, and can support a correct walking posture.

Patent Literature 1 discloses a method for producing an upper using heat-shrinkable yarns, as an example of a method for simply providing a shoe with good fitness. The upper produced by this method retains its shape conforming to a shoe last used in production, and therefore can provide a shoe including an upper that fits well to the shape of the shoe last.

Meanwhile, almost no method for simply producing a shoe with an upper conforming to the shape of the foot other than the method of Patent Literature 1 is known, and thus there is an ongoing demand for other useful methods for simply producing a shoe having excellent fitness.

On the other hand, there is also a need for customization of an upper, for example, by simply and easily adjusting the fitness to the user's foot at a specific place of the upper.

CITATION LIST

Patent Literature

Patent Literature 1: WO 2017/115805 A

SUMMARY

Technical Problem

In view of the aforementioned problems, it is an object of the present invention to provide a shoe upper that is capable of being customized by simply and easily adjusting its fitness to the user's foot, and a method for producing the shoe upper.

Solution to Problem

A shoe upper according to the present invention includes an upper body including a region having elasticity, and a film arranged in the region, in which the film has a heat shrinkage rate of 30% or more at least in one direction.

A method for producing a shoe upper according to the present invention includes: a preparation step of preparing an upper body including a region having elasticity; an arrangement step of arranging a film in the region of the upper body, in which the film has a heat shrinkable rate of 30% or more at least in one direction; an attachment step of attaching the upper body to a shoe last or foot; and a heating step of, after the arrangement step and the attachment step, heating the upper body with the film arranged thereon to thereby allow the film to shrink to conform to the shoe last or foot.

DESCRIPTION OF EMBODIMENTS

Figure 1:
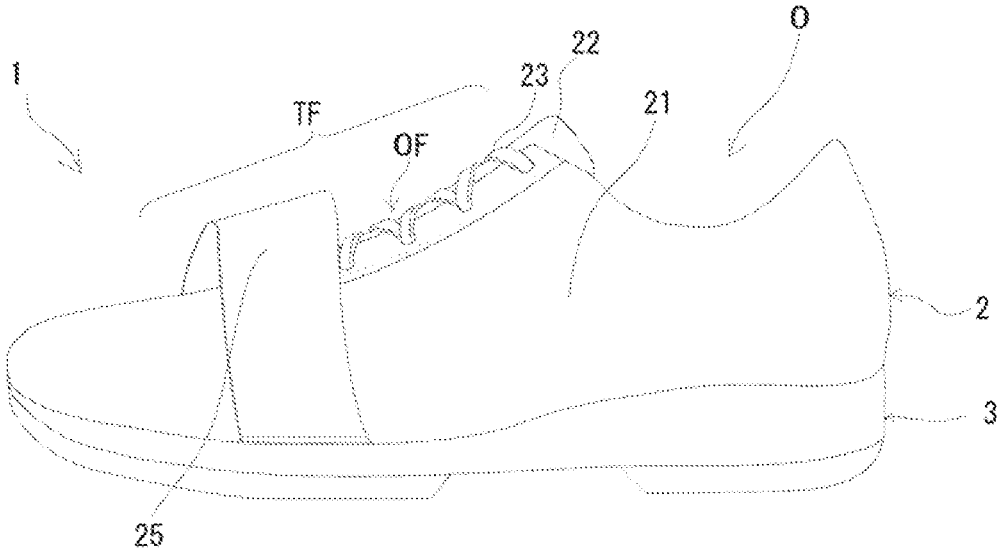
FIG. 1 is a lateral side view showing a shoe including an upper according to a first embodiment.

Hereinafter, embodiments of an upper and a method for producing the same of the present invention will be described with reference to the drawings. The following embodiments are merely described as examples. The present invention is not limited to the following embodiments at all.

In each of the drawings referred to in the embodiments or the like, members having substantially the same function will be referred to with the same reference sign. Further, the drawings referred to in the embodiment are those schematically drafted, and the ratio of the dimensions of the object depicted in the drawings or the like may be different from the ratio of the dimensions of the actual object or the like.

Herein, the description will be made with a straight line passing through an end of a toe side and an end of a heel side of the shoe being referred to as a center line of the shoe, a direction along the center line being as a longitudinal direction, a direction orthogonal to the longitudinal direction and parallel to the ground engaging surface of the shoe being as a width direction, and a direction orthogonal to the longitudinal direction and perpendicular to the ground engaging surface of the shoe being as a height direction. Further, a toe side in the longitudinal direction is referred to as a front side, a ground engaging surface side in the height direction of the shoe is as a lower side, and its opposite side is as an upper side. Still further, when the end of the shoe toe side is designated as a 0% position, and the end of the shoe heel side is designated as a 100% position, a region in the range of 0% to 30% positions in the longitudinal direction (herein, the 30% position includes the position that lies on a straight line extending in the width direction orthogonal to the center line and passing the point on the shoe center line at which the 30% position lies. The same is applicable to the following definitions) is referred to as a forefoot portion, a region in the range of 30% to 80% is as a midfoot portion, and a region in the range of 80% to 100% is as a hindfoot portion. Here, these regions are designated by the areas when the shoe is viewed from the top side.

Herein, unless otherwise stated, the inward side of the shoe is a side corresponding to the medial side according to the anatomical position of the foot sole (side close to the median), and the outward side of the shoe is a side corresponding to the lateral side according to the anatomical position of the foot sole (side far from the median).

First Embodiment

FIG. 1 shows a shoe 1 including an upper 2 according to a first embodiment of the present invention. As shown in FIG. 1, the shoe 1 includes the upper 2 and a shoe sole 3.

The upper 2 includes an upper body 21 that includes a region having elasticity, and a film arranged in this region. Herein, the configuration in which a certain object or region has elasticity means a configuration enabling the object or region which is held in a stationary state without an external force applied thereon to be stretchable in a certain direction in which the object or region is subjected to a tensile force, and to return to the original shape when the object or region has been released from the tensed state and hence come into the stationary state again. For example, although no limitation is applied to the elasticity, the region having elasticity and included in the upper body 21 can be made to stretch in the tensile force applying direction up to 110% or more, sometimes 120% or more, preferably 150% or more relative to the dimension in the stationary state.

The upper 2 of this embodiment further includes a tongue 22 and a lace 23 on the upper body 21. Specifically, the upper body 21 of this embodiment has an upper part defining an opening O at a position at which an upper part of the ankle and a part of the instep of the wearer's foot are exposed. The tongue 22 is provided to cover a part OF of the opening O provided in the upper body 21, the part OF of the opening O allowing a part of the instep of the foot to be exposed therethrough. The tongue 22 is fixed to the upper body 21, for example, by being sewn to the upper body 21. The lace 23 is arranged by being passed through a plurality of holes provided along the peripheral edges of the opening OF of the upper body 21. The lace 23 is a member for bringing the peripheral edges of the opening OF, along which the tongue 22 is provided, close to each other in the width direction, and is configured to be fastened while the wearer's foot is inserted into the upper body 21, thereby enabling the upper body 21 to tightly contact the wearer's foot. It is not essential that the upper 2 include the tongue 22 and the lace 23. For example, the upper body 21 may be configured to employ, instead of the lace 23, a hook-and-loop fastener for tight contact with the wearer's foot. The upper body 21 may be a sock shaped upper body without the tongue 22.

As described above, the upper body 21 is configured to include at least a part of region having elasticity. The region having this elasticity may be formed by knitted fabric (e.g., double raschel knitted fabric), or woven fabric or non-woven fabric which has elasticity. As shown in FIG. 1, the upper body 21 of this embodiment includes the aforementioned fiber sheet having a three dimensional shape conforming to the outer surface of the last (not shown), and therefore any region on the fiber sheet can be a region having elasticity.

The film 25 is a heat-shrinkable film that shrinks at a high temperature and is arranged in the region having elasticity of the upper body 21. The film 25 arranged in the upper body 21 is subjected to a later-described heating process so that the film 25 is allowed to shrink to conform to the shape of the upper body 21 in the region with the film 25 arranged therein. The film 25 thus heat shrunk can retain its shape conforming to the shape of the corresponding region of the shoe last or foot F. The film 25 thus heat shrunk has a relatively high rigidity and therefore can function to reinforce the aforementioned region of the upper body 21. As shown in FIG. 1 to FIG. 5, the film 25 is illustrated as having a substantially rectangular shape for ease of description, but the film 25 preferably has an edge cut into a curved shape to conform to a curve of the surface of the upper body 21.

Figure 2:
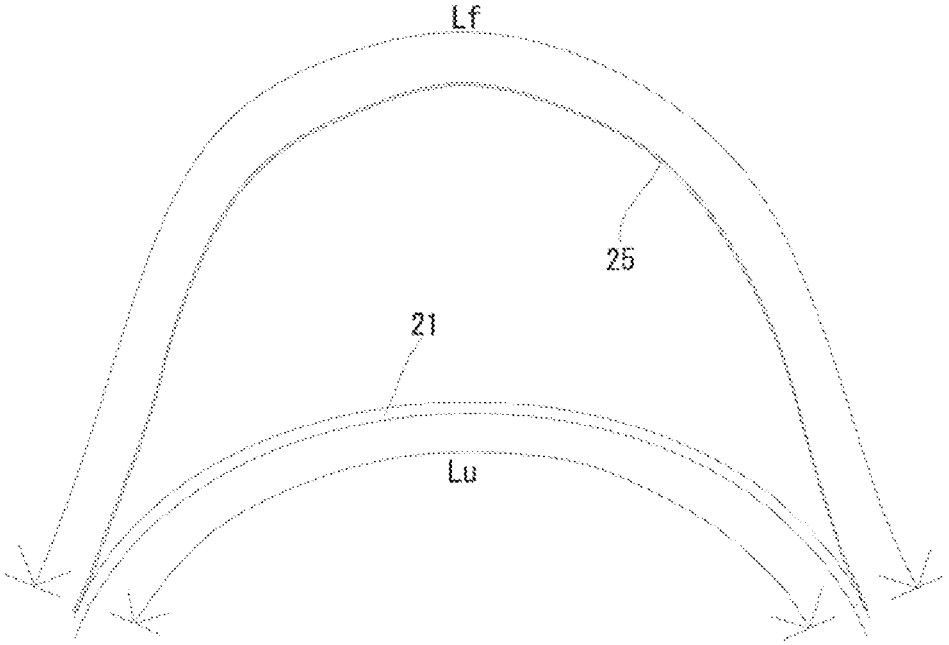
FIG. 2 is an upper side view of the shoe of FIG. 1.

As shown in FIG. 1 and FIG. 2, in this embodiment, the film 25 is arranged above a region TF corresponding to the instep of the foot of the wearer of the shoe 1 (hereinafter referred simply to as instep region TF), of the regions of the upper body 21 formed by the fiber sheet so as to cover the aforementioned region with a distance therebetween. More specifically, the film 25 extends from around the medial side end to around the lateral side end of the upper body 21 in the width direction on the front side of the opening OF in the instep region TF of the midfoot portion of the upper body 21. Thus, both ends of the film 25 are sewn and thereby joined to the upper body 21 so as to have seams formed on the outer surface of the upper body 21 in the longitudinal direction of the shoe 1 along the medial side end and the lateral side end (i.e., along the joined portion formed at the time of joining the upper 2 to the shoe sole 3). In the case where the film 25 is arranged over substantially the whole area in the width direction from around the medial side end to around the lateral side end as in this embodiment, the film 25 is preferably arranged on the front side of the opening OF. Both ends of the film 25 are sewn around the medial side end and around the lateral side end, respectively in FIG. 1 and FIG. 2. However, the sewing positions of both ends of the film 25 may be closer to the center in the width direction than the both ends of the upper body 21. Or, the film 25 may be additionally fixed to positions other than the both ends of the upper body 21. For example, the film 25 may be additionally sewn to substantially the center in the width direction of the upper body 21.

In the case where the film 25 is arranged by being sewn to the outer surface of the upper body 21 as in this embodiment, the film 25 can be easily removed from the upper body 21 by unstitching the seams, and can be easily re-arranged on the upper body 21 by being sewn again. Thus, according to the upper 2 with the film 25 detachably arranged on the upper body 21, the film 25 may be arbitrarily arranged at any place or arbitrarily replaced with a different kind of the film 25 according to the intended use of the shoe, the wearer's preference and/or the size of the wearer's foot.

Figure 3:
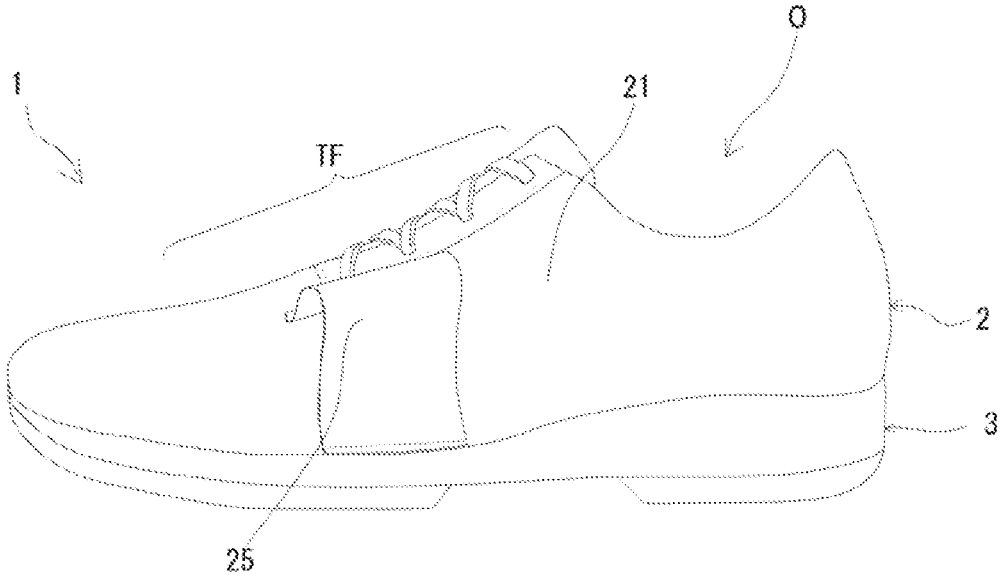
FIG. 3 is a lateral side view showing a shoe including the upper of the first embodiment in a modified form.

The film 25 does not necessarily extend over the entire foot width from around the medial side end to around the lateral side end. For example, as shown in FIG. 3, the film 25 may be arranged in the instep region TF of the upper body 21 while avoiding the region around substantially the center in the width direction in which the lace 23 is arranged. More specifically, as shown in FIG. 3, the film 25 may be arranged, in the instep region TF of the upper body 21, to extend in the area from around the medial side end to around the position corresponding to the position of the end of the opening OF on the medial side of the hindfoot portion, and to extend in the area from around the lateral side end to around the position corresponding to the position of the end of the opening OF on the lateral side of the hindfoot portion. The film 25 may be formed only partly in the above areas. For example, the film 25 may be arranged only around the medial side end and around the lateral side end or may be arranged only around the position corresponding to the position of the end of the opening OF. Further, the film 25 may be arranged to extend beyond the areas shown in FIG. 1 and FIG. 3 in the longitudinal direction of the shoe within the area of the instep region TF.

The film 25 is a film that has a length in one direction shrinking by 30% or more with heat. That is, the film 25 has a heat shrinkage rate of 30% or more in one direction. The film 25 has a heat shrinkage rate of preferably 40% or more, more preferably 50% or more and 80% or less in the one direction. In this embodiment, the one direction is the width direction of the shoe 1, and the film 25 has a heat shrinkage rate of 30% or more in the width direction under the conditions that the film 25 is arranged on the instep region TF of the upper body 21.

When the distance between the jointed portions measured along the outer surface of the upper body 21 (fiber sheet) is designated as (Lu), the film 25 can generally heat shrink up to a length equivalent to this distance (Lu). The upper 2 can improve its fitness by the heat shrinking of a film, provided that the relationship below is satisfied, in which the heat shrinkage rate of the film is X (%) and the length between the jointed portions of the film before heat shrinkage is (Lf):

$$[(Lf-Lu)/Lf]<(X/100)$$

Therefore, the film 25 may be joined so as to conform to the outer surface of the upper body 21 or joined to have a portion between the jointed portions away from the upper body 21.

The film 25 increases its thickness by the heat shrinking. For the purposes of not only improving the fitness but also exerting a reinforcing effect by the film after heat shrinking (hereinafter referred also to as shrunk film 25A), it is preferable that the film 25 before heat shrinking be joined to the upper body 21 provided with the capability of enabling the film 25 to heat shrink at a high rate. In this embodiment, the film 25 is joined to the upper body 21 while extending upwardly from the joined portions to form the shape of an arch.

The length (Lf) between the joined portions of the film 25 before heat shrinking is preferably 1.1 times or more, more preferably 1.2 times or more of the distance (Lu). The length (Lf) between the joined portions of the film 25 before heat shrinking is preferably 2.5 times or less, more preferably 2 times or less, of the distance (Lu).

The aforementioned heat shrinkage rate can be a heat shrinkage rate when the film 25 is heated to a certain temperature, such as 150° C. or less, more preferably 120° C. or less, further preferably 100° C. or less, most preferably 80° C. or less. The film 25 can heat shrink at the aforementioned heat shrinkage rate when the film 25 is heated to the aforementioned temperatures for preferably 30 seconds or less, more preferably 10 seconds or less. Using this kind of film 25 enables the subsequent heating step for heat shrinking the film at a relatively low temperature and/or in a relatively short time, so that the upper 2 can be heated by a relatively simple equipment. In addition, in the heating step, the effect of heating at the high temperature receivable by, in addition to the film 25, the upper 2 and the other members constituting the shoe 1, and other elements included in the equipment (e.g., the wearer's foot of the shoe 1) can be reduced.

However, when the temperature which causes the heat shrinking of the film 25 is excessively low, the film 25 may undesirably heat shrink in the case where the upper 2 and the shoe 1 including the upper 2 are placed in a storing site such as a warehouse and the environmental temperature of the warehouse is increased, for example, in summer. Therefore, the aforementioned heat shrinkage rate can be a heat shrinkage rate at the time when the film 25 is heated to a certain temperature, preferably 50° C. or more, more preferably 60° C. or more, further preferably 70° C. or more. It is also preferable that the film 25 start heat shrinking at such a temperature mentioned above.

The film 25 may be a film that has a heat shrinkage rate in one direction (e.g., the width direction of the shoe 1) being different from that in another direction different from the one direction (e.g., the longitudinal direction of the shoe 1). In other words, the heat shrinkage rate of the film 25 may have an anisotropic character.

The film 25 of this embodiment has a heat shrinkage rate of 30% or more in the width direction as the one direction in the state where the film 25 is arranged in the instep region TF of the upper body 21, while having a heat shrinkage rate of less than 30% in the longitudinal direction as the other direction. The heat shrinkage rate of the film 25 in the longitudinal direction is preferably 10% or less, more preferably 5% or less. As long as the heat shrinkage rate of the film 25 in the one direction is 30% or more, the film 25 need not heat shrink in the other direction (e.g., the longitudinal direction of the shoe 1) but may heat expand instead.

In the case where the film 25 is fixed to the upper body 21 along a fixed line (e.g., seams at the ends on the medial and lateral sides of the film 25) extending in a certain direction (e.g., the longitudinal direction of the shoe 1) as in this embodiment, the heat shrinkage rate in the certain direction is preferably smaller than that in a direction different from the certain direction (e.g., the width direction of the shoe 1). Here, the direction different from the certain direction may be a direction substantially perpendicular to the certain direction.

The film 25 having a heat shrinkage rate having an anisotropic character may be a film subjected to a stretching treatment in the one direction. The stretching treatment is performed using a known method.

However, the heat shrinkage rate of the film 25 need not have an anisotropic character. That is, the film may have the same heat shrinkage rate in any direction.

Examples of the material of the film 25 usable to cause the heat shrinking of the film 25 as mentioned above include: polyester based resins such as polyethylene terephthalate (PET), polybutylene terephthalate (PBT), and polyethylene naphthalate (PEN); polyolefin based resins such as polyethylene (PE) and polypropylene (PP); chlorine based resins such as polyvinyl chloride (PVC) and polyvinylidene chloride (PVDC); polystyrene based resins such as styrene-butadiene copolymer; and polyurethane based resins. These materials may be solely used, or plural kinds of materials may be used in combination.

The thickness of the film 25 is preferably in the range of 10 to 100 μm without limitation thereto. The thickness of the film 25 is more preferably in the range of 20 to 80 μm. The bending rigidity of the film 25 is preferably higher than the bending rigidity of the upper body 21 in terms of making it possible for the upper body 21 to stably retain its shape after heat shrinking.

The length of the film 25 is set to be greater than the length of the region in which the film 25 is arranged (the length in the width direction in this embodiment) to such an extent as to enable the heat shrunk film to conform to the shape of the upper body 21. Therefore, in this embodiment, the film 25, which is arranged on the outer surface of the upper body 21 and has the medial side end and the lateral side end sewn to the upper body 21 in the instep region TF as the aforementioned region of the upper body 21, extends upwardly from the sewn ends to form the shape of an arch.

As mentioned above, the film 25 of this embodiment is joined to the instep region TF of the upper body 21 with the medial side end and the lateral side end sewn to the outer surface of the upper body 21. The film 25 may be joined to the upper body 21 at any one place or plural places thereof, instead of, or in addition to the medial side end and the lateral side end. For example, the film 25 may be joined to the upper body 21 along the entire peripheral edge thereof, or may be joined thereto only at a center portion, or may be joined to the upper body 21 at plural places over the entire film 25 with the entire surface of the film 25 substantially contacting the surface of the upper body 25.

Also, the film 25 is not necessarily joined to the instep region TF by being sewn, and may be able to be detachably or undetachably arranged in the instep region TF of the upper body 21 by any method. For example, the film 25 may be joined to the instep region TF of the upper body 21 via a thermoplastic adhesive or a heat curing adhesive, or joined directly thereto. For this, the film 25 may exert adhesiveness by being heated so that the film after heat shrinking (shrunk film 25A) is joined to the upper body 21 through its entire surface. For example, it may be configured such that the film 25 has a heat shrinkable substrate layer, one or both sides of which are provided with a hot-melt adhesive layer, so that the film 25 is joined to the upper body 21 through its entire surface by the adhesive force of the hot-melt adhesive layer before heat shrinking. Or, the film 25 may be detachably joined to the instep region TF of the upper body 21 by being fixed thereto with a safety-pin or the like.

Further, the film 25 may be arranged not on the outer surface of the upper body 21, but on the inner surface of the upper body, that is, the surface of the upper body 21 facing the inner space of the shoe 1. Or, the film 25 may be arranged inside a material constituting the upper body 21. For example, in the case where the instep region TF of the upper body 21 is formed by two fiber sheet layers, the film 25 may be movably or unmovably arranged between these fiber sheet layers. In addition, the film 25 may be arranged on the upper body 21 by the configuration in which a part of an elastic region of the upper body 21 is cut away therefrom and the film 25 is filled in this cut region to be thus joined to the upper body 21. In the case where the film 25 is arranged on the outer surface of the upper body 21 and joined thereto only at both ends as in this embodiment, the film 25 is curved upward and thereby preferably allows its excess length to be escaped to the upper side.

One piece of the film 25 is arranged on the upper body 21 in this embodiment, but the number of the films 25 is not particularly limited thereto. Two or more pieces of the film 25 may be arranged on the upper body 21.

Now, the description will be made for a method for producing an upper 2A including a film after heat shrinking, that is, a heat shrunk film 25A in a region in which the film 25 is to be arranged, using the aforementioned upper 2.

First, the upper body 21 including a region having elasticity is prepared (preparation step), and then the film 25 having a heat shrinkage rate in one direction of 30% or more is arranged in this region of the upper body 21 (arrangement step). In this embodiment, one piece of the film 25 is arranged on the instep region TF of the upper body 21 and thereby the upper 2 is produced.

As the film 25 arranged in the arrangement step, a film having a desirable rigidity, shrinkage rate and shrinkage temperature according to the intended use is appropriately selected. For example, if the user of the upper 2A to be produced prefers an upper 2A reinforced by the shrunk film 25A having a relatively high rigidity, a film having a relatively high rigidity and/or shrinkage rate may be selected as the film 25. In the case where the heating is performed with the upper body 21 fitted to the foot of the wearer, a film that shrinks at a relatively low temperature may be selected as the film 25.

In this embodiment, as a method for arranging the film 25 on the upper body 21, a method, which includes joining the film 25 to the upper body 21 by sewing both ends of the film 25 to the outer surface of the upper body 21, is used. Specifically, the arranging direction of the film 25 on the upper body 21 is determined to allow the direction in which the heat shrinkage rate of the film 25 is 30% or more to be the width direction of the upper body 21. Here, in the case where the heat shrinkage rate of the film 25 has an anisotropic character, the arranging direction of the film 25 is determined to allow the direction in which the film 25 has a higher shrinkage rate to be the width direction of the upper body 21. Then, one end in the width direction of the film 25 is brought into contact with the outer surface of the upper body 21 and sewn to the upper body 21 at this contact position. Then, the other end in the width direction of the film 25 is moved toward the previously sewn one end in the width direction of the film 25 and thereby causes the portion between the both ends of the film 25 to be curved upward to form the shape of an arch, then while keeping this state, the other end in the width direction of the film 25 is brought into contact with the outer surface of the upper body 21 and sewn to the upper body 21 at this contact position. Thus, the upper 2 including one piece of the film 25 having the medial side end and the lateral side end respectively joined to the medial side and the lateral side of the upper body 21 is produced.

Subsequent to the production of the upper 2 by the aforementioned steps, the shoe 1 may be optionally produced by attaching the upper 2 to the shoe sole 3 using a known method.

Then, the upper body 21 is attached to the shoe last or actual foot F (attachment step). In this embodiment, the upper body 21 is attached to the foot F of the user who will wear the shoe including the thus produced upper.

Figure 4:
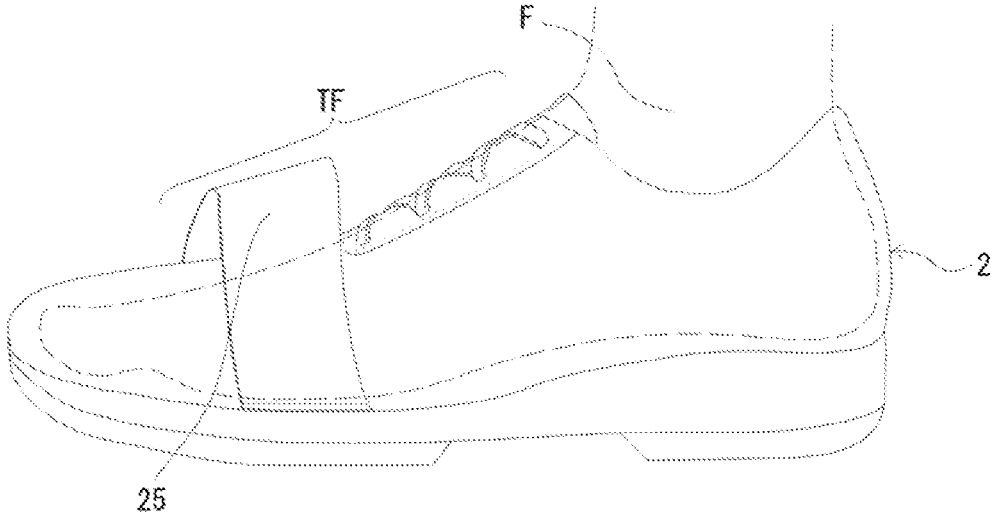
FIG. 4 is a schematic view showing the state where a film is arranged on a fiber sheet included in the upper of the shoe of FIG. 1.

As shown in FIG. 4, the upper body 21 is attached to the shoe last to be used or foot F to conform to the shape of the shoe last or foot F, preferably in the state where the upper body 21 is substantially held in tight contact with the shoe last or foot F by any method. As the shoe last or foot F to be used in this step, those appropriate to the intended size of the shoe including the upper body 21 are chosen. For example, in the case where the upper body 21 constitutes a part of the shoe 1 including the upper 2 and the shoe sole 3, the shoe 1 is fitted to the shoe last or foot F having an appropriate size in usual manner so that the upper body 21 can be easily attached to the shoe last or foot F. Alternatively, the upper body 21 may be attached to the shoe last or foot F while being held in substantially tight contact therewith by temporarily fixing the inner surface of the upper body 21 to the surface of the shoe last or foot to be used, using any method.

In the upper body 21 of this embodiment, a region around the opening OF of the upper body 21 can be brought into tight contact with the shoe last or foot F by fastening the lace 23 provided on the upper body 21.

Instead of performing the attachment step after the arrangement step of arranging the film 25 on the upper body 21 as described above, the arrangement step may be optionally performed after the attachment step is performed. In such a case, the film 25 is arranged on the upper body 21 in the state where the upper body 21 is attached to the shoe last or foot.

Figure 5:
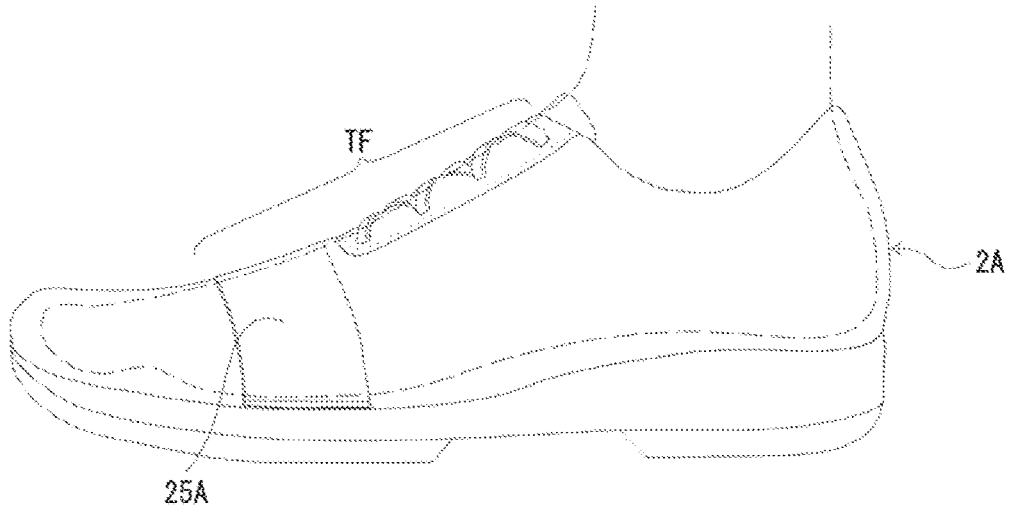
FIG. 5 is a lateral side view showing the shoe including the upper after the film included in the upper of the shoe of FIG. 4 has been allowed to heat shrink.

Thus, the upper body 21 with the film 25 arranged thereon is heated (heating step) in the state where the upper body 21 with the film 25 arranged thereon is attached to the shoe last or foot F. Thereby, as shown in FIG. 5, the film 25 heat shrinks to have a shape conforming to the shoe last or foot F in a region in which the film 25 on the upper body 21 is arranged, and hence turns to the shrunk film 25A. The shrunk film 25A thus heat shrunk can retain its shape conforming to the shape of the corresponding region of the shoe last or foot F. Also, the shrunk film 25A can function to reinforce this region of the upper body 21 with a relatively high rigidity.

The upper body 21 is heated at any temperature for any time, which enable the film 25 to heat shrink. For example, the film 25 is heated at a temperature of 50° C. to 150° C. using a heat source, which enables the film 25 to heat shrink, for 30 seconds or less, preferably 10 seconds or less. Here, in the case where the upper body 21 is heated while being attached to the wearer's foot, it is preferable that the heat shrinking of the film 25 be completed at a lowest possible temperature and for a shortest possible time enabling the heat shrinking of the film 25 in order to reduce the load applied to the wearer's foot due to the heat. In such a case, the upper body 21 may be attached to the wearer's foot with an insulating material such as a sock having an improved heat insulating capability being attached to the wearer's foot.

The method for heating the upper body 21 is not particularly limited to a specific one, provided that it can enable the film 25 to heat shrink. For example, the upper body 21 is heated by blowing hot air having a temperature enabling heat shrinking of the film 25 to the region in which the film 25 of the upper body 21 is arranged, or the instep region TF in this embodiment. In this case, a hot air blowing means may be configured such that the upper body 21 is placed on a device such as a treadmill having a movable placement surface, and the upper body 21 is moved by moving the placement surface in front of a fixed hot air blower (e.g., a dryer or the like). Or, the upper body 21 may be heated by being placed in a heating chamber such as an oven, which is set at a temperature enabling the film 25 to heat shrink, for a certain time. Here, in the case where the upper body 21 is heated while being attached to the wearer's foot, the wearer places his or her foot fitted into the upper body 21 in the heating chamber to allow the upper body 21 to be heated therein.

In the case where the upper body 21 is heated while being attached to the wearer's foot, the upper body 21 is preferably heated while the wearer holds his or her foot in a stationary state. However, the wearer does not necessarily hold his or her foot in a stationary state during heating. The upper body 21 may be heated while the wearer is moving his or her foot.

As described above, the film 25 of the upper 2 heat shrinks in the region in which the film 25 is arranged so that the upper 2A including the shrunk film 25A having a shape conforming to the shape of the corresponding region of the used shoe last or foot F can be produced. The thus produced upper 2A can retain the shape conforming to the shape of the used shoe last or foot F in the region in which the shrunk film 25A is arranged. Therefore, the upper 2A with improved fitness to the used shoe last or foot can be produced. Further, the upper 2A with the aforementioned region reinforced with a relatively high rigidity of the shrunk film 25A can be produced.

In particular, in the case where the upper body 21 is attached to the foot of the wearer who will actually use the shoe including the produced upper in the attachment step, and then is heated in the heating step, the film 25 heat shrinks to conform to the shape of the foot F of the wearer. Thus, it is possible to produce the upper 2A having fitness customized to the foot of the actual user of the shoe.

The method of arranging the film 25 on the upper body 21 in the arrangement step is not limited to the abovementioned method in which both ends of the film 25 are sewn on the outer surface of the upper body 21. For example, the arrangement of the film 25 may be made by any method as described in relation to the shoe 1. The arrangement position of the film 25 is not limited to the position on the outer surface of the upper body 21. For example, the film 25 may be arranged in any region having elasticity of the upper body 21 as described in relation to the shoe 1.

Second Embodiment

Figure 6:
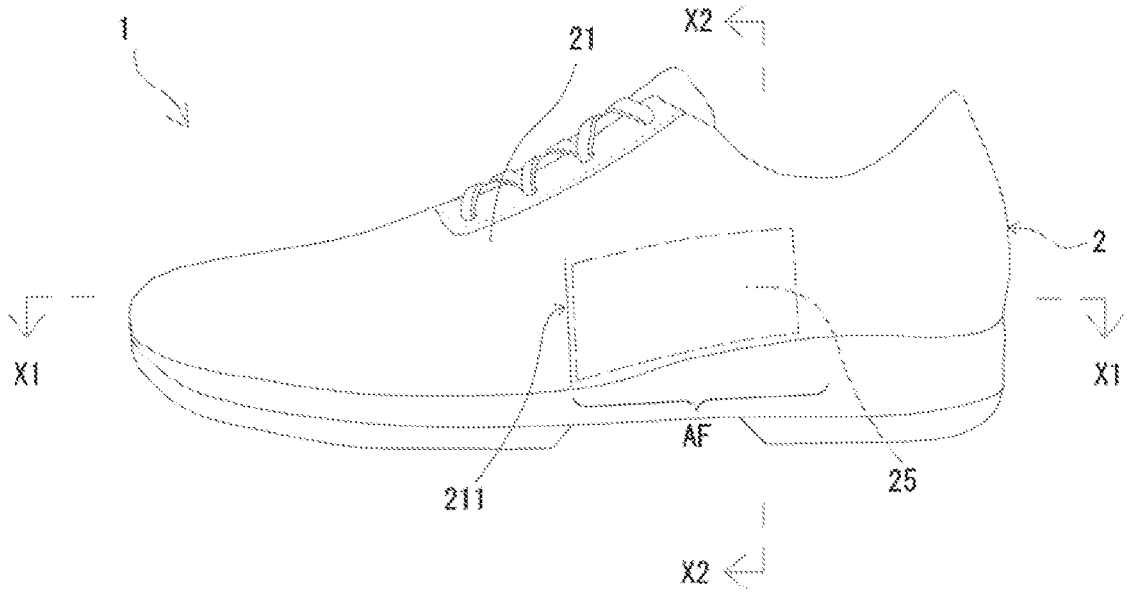
FIG. 6 is a lateral side view showing a shoe including an upper according to a second embodiment.

FIG. 6 shows a shoe 1 including an upper 2 according to a second embodiment of the present invention. The upper body 21 including a region having elasticity, which is included in the upper 2, includes a fiber sheet having elasticity and a three dimensional shape conforming to the outer surface of the last (not shown) in a similar manner to the first embodiment.

Figure 7:
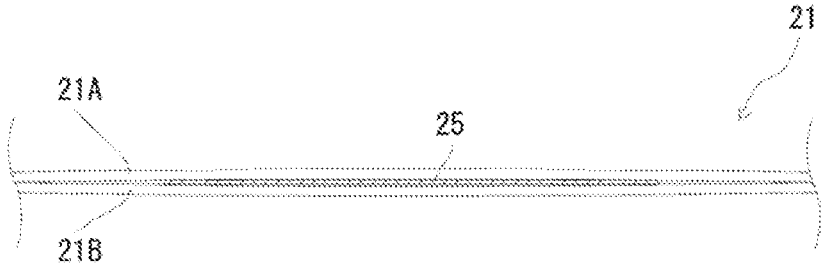
FIG. 7 is a schematic view showing the state where a film is arranged inside a fiber sheet included in the upper of the shoe of FIG. 6.

In this embodiment, the film 25 included in the upper 2 is arranged inside a fiber sheet in a region in which an arch region AF of the upper body 21 is located, that is, a region at the center in the longitudinal direction on the medial side in which a medial longitudinal arch of the foot of the wearer of the shoe 1 is located. Specifically, as shown in FIG. 7, the fiber sheet constituting at least the arch region AF of the upper body 21 includes a fiber sheet layer 21A provided on the inner surface side of the upper body 21, and a fiber sheet layer 21B provided on the outer surface side of the upper body 21. The film 25 is arranged unmovably or movably between the overlapped two fiber sheet layers 21A and 21B. As shown in FIG. 7, the lower end of the film 25 is preferably located as close as possible to the lower end of the upper body 21 (around the joined portion along which the upper 2 is joined to the sole 3). The upper end of the film 25 is preferably located above the line extending in the longitudinal direction of the shoe 1 connecting the innermost point of the arch region AF which is recessed inward of the upper body 21.

In this embodiment, an insertion opening 211 through which the film 25 is insertable between the fiber sheet layers 21A and 21B is formed in the outer surface of the fiber sheet included in the upper body 21, in the arch region AF of the upper body 21. More specifically, in this embodiment, a vertical cut 211 is formed at a part of the fiber sheet layer provided on the outer surface side in the arch region AF of the upper body 21, so that the film 25 is insertable between the fiber sheet layers 21A and 21B from the cut 211.

The film 25 may be movably arranged as it remains unchanged from the inserted state between the fiber sheet layers 21A and 21B or may be fixed between the fiber sheet layers 21A and 21B by any means after insertion. For example, the film 25 arranged inside the fiber sheet may be fixed by being sewn at least partly to one or both of the fiber sheet layers 21A and 21B. Or, the movement of the film 25 inside the fiber sheet may be restricted by a hook and loop fastener provided on the opposite surfaces of the fiber sheet layers 21A and 21B in the arch region AF of the upper body 21, in which the fiber sheet layers 21A and 21B around the outer periphery of the inserted film 25 are fastened together by the hook and loop fastener. In the case where the film 25 is arranged in the arch region AF of the upper body 21, it is preferable that the film 25 be joined inside the fiber sheet of the upper body 21 with its both ends in the longitudinal direction of the shoe 1 sewn so as to have seams oriented in the width direction of the shoe 1.

Also, in the case where the film 25 is movably arranged inside the fiber sheet, the fiber sheet layers 21A and 21B may be joined together so as to surround the outer periphery of the arch region AF of the upper body 21, so that the film 25 is prevented from moving across the arch region AF. A sealing structure such as a fastener may be provided around the insertion opening 211 so as to prevent the inserted film 25 from moving out from the insertion opening 211.

In this embodiment, a film having a higher rigidity than the film 25 of the first embodiment is preferably used. The film 25 having such a high rigidity can provide more effective support to the medial longitudinal arch of the wearer's foot arch by the shrunk film 25A in the shoe 1 including the upper having the film 25 heat shrunk.

When the upper 2 of this embodiment is produced, the upper body 21 is prepared (preparation step), and then the film 25 is inserted between the fiber sheet layers 21A and 21B from the insertion opening 211 formed in the arch region AF of the upper body 21 to thereby arrange the film 25 in the arch region AF of the upper body 21 (arrangement step). Thus, with the aforementioned configuration of the upper body 21 of this embodiment, it is possible to arrange the film 25, which is selected according to the preference of the user of the upper body 21, in the aforementioned region. Optionally, in this step, the film 25 which has been inserted between the fiber sheet layers 21A and 21B may be fixed at the inserted position by the aforementioned optional means.

When the thus arranged film 25 is allowed to heat shrink, it is preferable that hot air be blown toward the film 25 from the medial side of the upper 2 in order to allow the film 25 to heat shrink along the arch of the shoe last or foot F in the heating step.

Figure 8:
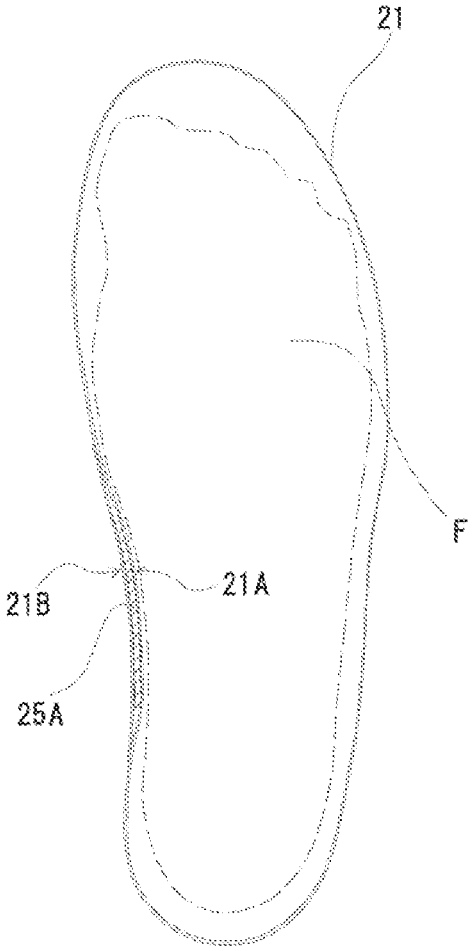
FIG. 8 is a cross sectional view taken along the line X1-X1 of the upper of the shoe of FIG. 6.
Figure 9:
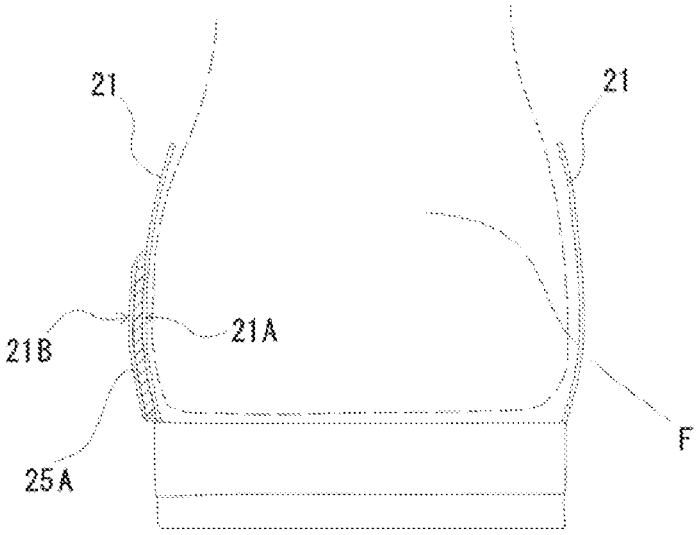
FIG. 9 is a cross sectional view taken along the line X2-X2 of the upper of the shoe of FIG. 6.

FIG. 8 and FIG. 9 are respectively cross sectional views taken along the line X1-X1 (substantially horizontal sectional view) and taken along the line X2-X2 (substantially vertical sectional view) of the upper after the film 25 included in the upper 2 of FIG. 6 has been heat shrunk in the heating step. As shown in FIG. 8, the heat-shrunk film 25A shrinks along the recessed shape on the medial side of the arch of the shoe last or foot F and thus has a shape including a negative curvature. Also, as shown in FIG. 9, the heat-shrunk film 25A has a curved shape so as to support the medial longitudinal arch of the arch of the shoe last or foot F. Thus, according to the shoe provided with the upper including the heat-shrunk film 25A, the heat-shrunk film 25A can support the arch of the wearer's foot so as to suppress the medial longitudinal arch of the wearer's foot arch from being depressed more downward than a desirable position.

As described above, the shoe upper of the present invention includes an upper body including a region having elasticity, and a film arranged in this region, in which the film has a heat shrinkage rate of 30% or more at least in one direction. Therefore, according to the present invention, the upper in a state of being attached to the shoe last or foot is heated to thereby allow the film to heat shrink, so that it is possible to provide the upper that can retain the shape of the region in which the film of the upper body is arranged, in conformity to the shape of the corresponding region of the shoe last or foot. The upper of the present invention can be easily produced by arranging the aforementioned heat-shrunk film in a region for which the shape of the upper body is desired to be retained. Therefore, it is possible to easily provide the upper of the present invention, which includes the film selected according to the preference of a person who will become a user of the shoe including the upper, for example, at a place where a shoe including the upper is purchased. Further, according to the upper of the present invention, the film can be detachably arranged on the upper body. In such a case, there is an advantage that the film which has been once attached to the upper body can be detached according to the needs for re-adjustment of the fitness.

The temperature at which the heat shrinkage rate in the one direction of the film is 30% or more is preferably 50° C. or more and 150° C. or less. In such a case, the upper can be heated with a relatively simple equipment. The thickness of the film is preferably 10 to 100 μm.

The film may be joined to the upper body at both ends in the one direction of the film. In such a case, a margin to shrink can be secured between the both ends of the film.

The film may be at least partly exposed on the outer surface side of the upper body. In such a case, a margin to shrink of the film can be secured outside the upper body. Or, the aforementioned region of the upper body includes at least two layers, and the film may be arranged between the two layers. In such a case, expansion and contraction of the upper body due to the heat shrinking of the film can be reduced. In addition, since the film is not exposed on the outer surface, the film is less likely to be damaged.

The heat shrinkage rate in the one direction of the film may differ from the heat shrinkage rate in the other direction of the film, which is different from the one direction of the film. In such a case, the expansion and contraction of the upper body due to the heat shrinking of the film can be easily controlled. Also, the expansion and contraction rate in a desirable direction can be adjusted.

The film may be arranged in at least one of the instep region and the arch region of the upper body. In such a case, the shape of the region, for which the shape of the upper body is desired to be retained, can be effectively retained by the heat-shrunk film. In this regard, the heat shrinkage rate of the film in the width direction of the shoe is preferably larger than the heat shrinkage rate of the film in the longitudinal direction of the shoe. In such a case, the expansion and contraction of the upper body due to the heat shrinking of the film can be easily controlled.

Further, a method for producing a shoe upper of the present invention includes: a preparation step of preparing an upper body including a region having elasticity; an arrangement step of arranging a film in the region of the upper body, in which the film has a heat shrinkage rate of 30% or more at least in one direction; an attachment step of attaching the upper body to a shoe last or foot; and a heating step of, after the arrangement step and the attachment step, heating the upper body with the film arranged thereon to thereby allow the film to shrink to conform to the shoe last or foot. Thus, according to the present invention, it is possible to enable the upper to retain the shape of the region, in which the film of the upper body is arranged, in conformity to the shape of the corresponding region of the shoe last or foot by the heat-shrunk film. According to the method for producing the upper of the present invention, it is possible to simply and easily produce the upper that retains a shape of a region, in which the film is arranged, in conformity to the shape of the corresponding region of the shoe last or foot by heating the upper body with the heat shrinking film arranged thereon, for example, at a place where the shoe including the upper body is purchased. Further, there is an advantage that when the film is detachably arranged on the upper body in the arrangement step and then the fitness is checked before the heating step, the film which has been attached to the upper body can be removed for re-adjustment of the fitness, if necessary.

The film may be joined to the upper body at both ends in the one direction of the film in the arrangement step. In such a case, a margin to shrink can be secured between the both ends of the film.

The upper may be attached to the foot of a user who will use the shoe including the upper in the attachment step. In such a case, a shoe more appropriately fitting to the user's foot can be produced.

The upper body may be heated only for 30 seconds or less in the heating step. In such a case, the heating step can be simply and promptly completed. Further, in the case where the upper is heated while being attached to the wearer's foot, it is possible to reduce the load applied to the wearer's foot due to the heat.

The upper body may be heated using hot air in the heating step. In such a case, the heating step can be simply performed by a simple device. Further, the film is allowed to heat shrink to more appropriately conform to the shoe last or foot by blowing hot air toward the upper body and the shoe last or foot attached to the upper body.

The film may be arranged in at least one of the instep region and the arch region of the upper body in the arrangement step. In such a case, the shape of the region, for which the shape of the upper body is desired to be retained, can be effectively retained by the heat shrunk film. For this, it is preferable that the film shrink more largely in the width direction of the shoe than in the longitudinal direction of the shoe in the heating step. In such a case, expansion and contraction of the upper body due to the heat shrinking of the film can be easily controlled.

The shoe upper and the method for producing the upper of the present invention are not necessarily limited to the configurations of the above embodiments. The shoe upper and the method for producing the upper of the present invention are not necessarily limited to the aforementioned operational effects. The shoe upper and the method for producing the upper of the present invention can be subject to various modifications within the scope of the gist of the present invention.

Figure 10:
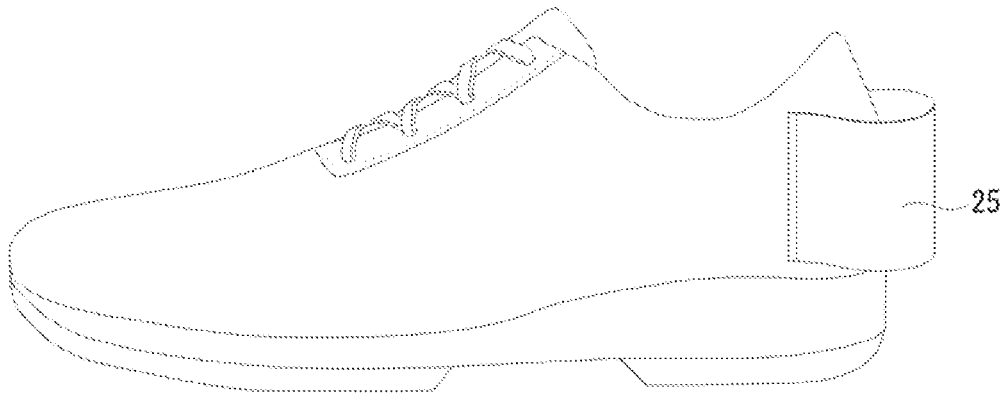
FIG. 10 is a lateral side view showing a shoe including an upper according to another embodiment.

For example, in the above embodiments, the film 25 is arranged in the instep region TF or the arch region AF of the upper body 21; however the film 25 may be arranged in any region other than these regions for which the shape conforming to the shape of the shoe last or foot is desired to be retained, according to the intended use of the shoe, the wearer's preference or the size of the wearer's foot. Also, as shown in FIG. 10, it may be configured such that a relatively thick film 25 (e.g., 60 to 100 μm) is arranged in a heel region of the upper body, by which a post-fitting heel counter can be formed. Although a simplified illustration is shown in FIG. 7, the shape of the film can be appropriately selected in order to allow the film to take various known shapes capable of securely supporting the heel when the heel counter is formed.

Figure 11:
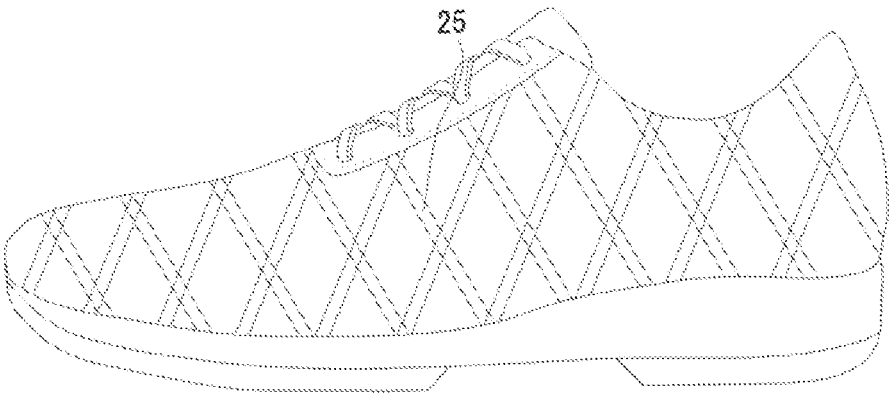
FIG. 11 is a lateral side view showing a shoe including an upper according to still another embodiment.
Figure 12:
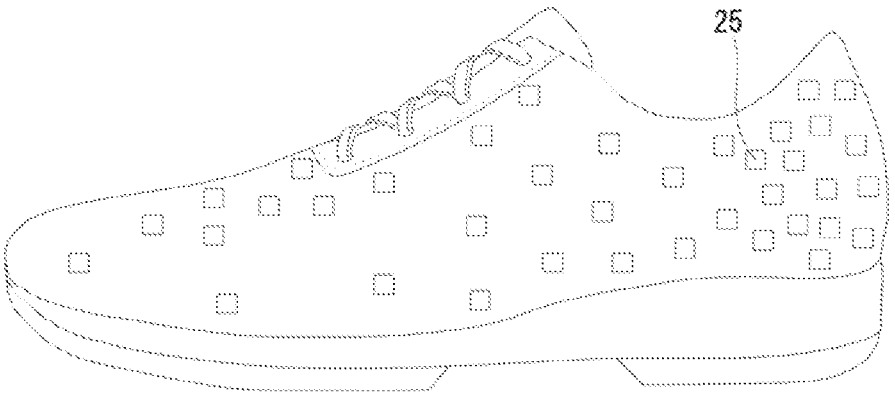
FIG. 12 is a lateral side view showing a shoe including an upper according to yet another embodiment.

Further, the film 25 may be arranged over the entire area of the upper body. The fitness to the upper body 21 is exhibited not only in the region in which the film is arranged. For example, if a plurality of the films 25 are arranged, the fitness may be exhibited also in a region between the plurality of the films 25. In the case where a plurality of the films 25 having their entire surfaces joined to the upper body are arranged with distances from each other and heated to shrink, a tension is applied between adjacent two heat-shrunk films. Therefore, in such a case, the fitness can be also exhibited in a region in which the film 25 is not arranged. The film 25 may be arranged over the entire area of the upper body in stripe pattern as shown in FIG. 11, or may be arranged over the entire area of the upper body in spot pattern as shown in FIG. 12. For this, the density of the film 25 arranged on the upper body may be adjusted for every region of the upper body to be thereby able to give a desirable rigidity distribution in the upper produced after the film 25 is heat shrunk. For example, the density of the film 25 arranged on the upper body may be increased in a region, for which the strength of the upper body is desired to be more increased than the other regions when the film 25 has been caused to heat shrink.

The film 25 is preferably arranged in a region which is relatively less likely to be bent when in use. In other words, it is unpreferable that the film 25 be arranged in a region which is relatively likely to be bent when in use. For example, it is unpreferable that the film 25 be arranged in a region corresponding to the MP joint of the foot, which is a most likely bent region of the upper body 21. In the case where the film 25 is arranged over a wide area, it is preferable that the film 25 be arranged to prevent itself from being directly positioned in such a bent region, for example, by dividing the film 25 for each region.

In the above embodiments, the film 25 is arranged on the outer surface of the upper body 21 in the instep region TF of the upper body 21, while being arranged inside the fiber sheet included in the upper body 21 in the arch region AF of the upper body 21. The arrangement forms of the film 25 are not necessarily limited thereto. For example, the film 25 may be arranged inside the fiber sheet included in the upper body 21 in the instep region TF of the upper body 21 or may be arranged on the outer surface of the upper body 21 in the arch region AF of the upper body 21.

In the above embodiments, the upper body 21 has elasticity in any region on the fiber sheet having a three-dimensional shape conforming to the outer surface of the last. The upper body of the present invention is not necessarily limited thereto. As long as a region in which the film 25 of the upper body is arranged has elasticity, it is not necessary for other regions to have elasticity. For example, the upper body of the present invention may be formed by a combination of synthetic leather having no elasticity and a double raschel knitted fabric having elasticity. In such a case, the region in which the film 25 of the upper body is arranged has the double raschel knitted fabric.

The region of the upper body 21 in which the film 25 is arranged may be further provided with an additional reinforcing material. For example, an additional reinforcing material may be arranged between the upper body 21 and the film 25 or may be arranged together with the film 25 by being inserted between the fiber sheet layers 21A and 21B included in the upper body 21.

Although no more detailed description will be repeated herein, matters, specifically technical matters of conventional arts relating to the shoe upper and the upper, which are not explicitly mentioned above, can be appropriately applied in the present invention.

REFERENCE SIGNS LIST

1: Shoe
2, 2A: Upper
21: Upper body
21A, 21B: Fiber sheet layer
22: Tongue
23: Lace

25, 25A: Film
3: Sole
O: Opening
OF: Opening (part of the opening through which a part of the instep of the foot is exposed)
TF: Instep region
AF: Arch region
F: Shoe last or foot

The invention claimed is:

1. A shoe upper comprising:

an upper body including a region having elasticity; and a film having ends, wherein only the ends of the film are directly attached to the region via a fastening member, the film being heat shrinkable in at least one direction of the film in a state of being attached to the region, and the film having a heat shrinkage rate of 30% or more at least in the one direction of the film in the state of being attached to the region.

2. The shoe upper according to claim 1, wherein the heat shrinkage rate in the one direction of the film in the state of being attached to the region of 30% or more occurs within a temperature range from 50° C. to 150° C.

3. The shoe upper according to claim 1, wherein the film has a thickness of 10 to 100 μm.

4. The shoe upper according to claim 3, wherein the film is joined to the upper body at both ends of the film in the one direction of the film.

5. The shoe upper according to claim 1, wherein the film is joined to the upper body at both ends of the film in the one direction of the film.

6. The shoe upper according to claim 5, wherein the film is at least partly exposed on an outer surface side of the upper body.

7. The shoe upper according to claim 5, wherein the heat shrinkage rate in the one direction of the film in the state of being attached to the region differs from the heat shrinkage rate in another direction of the film, which is different from the one direction of the film in the state of being attached to the region.

8. The shoe upper according to claim 5, wherein the film is arranged in at least one of an instep region and a medial longitudinal arch region of the upper body.

9. The shoe upper according to claim 1, wherein the film is at least partly exposed on an outer surface side of the upper body.

10. The shoe upper according to claim 1, wherein the region of the upper body includes at least two layers, and the film is arranged between the two layers.

11. The shoe upper according to claim 1, wherein the heat shrinkage rate in the one direction of the film in the state of being attached to the region differs from the heat shrinkage rate in another direction of the film, which is different from the one direction of the film in the state of being attached to the region.

12. The shoe upper according to claim 1, wherein the film is arranged in at least one of an instep region and a medial longitudinal arch region of the upper body.

13. The shoe upper according to claim 12, wherein the heat shrinkage rate of the film in the state of being attached to the region in a width direction of the shoe upper is larger than the heat shrinkage rate of the film in the state of being attached to the region in a longitudinal direction of the shoe upper.

14. A shoe upper comprising:

an upper body including a region having elasticity; and a film arranged in at least one of an instep region and a medial longitudinal arch region of the upper body, the film having ends, wherein only the ends of the film are directly attached to the region, the film being heat shrinkable in at least one direction of the film in a state of being attached to the region, and the film having a heat shrinkage rate of 30% or more at least in the one direction of the film in the state of being attached to the region.

15. The shoe upper according to claim 14, wherein the heat shrinkage rate in the one direction of the film in the state of being attached to the region of 30% or more occurs within a temperature range from 50° C. to 150° C.

16. The shoe upper according to claim 14, wherein the film has a thickness of 10 to 100 μm.

17. The shoe upper according to claim 14, wherein the film is joined to the upper body at both ends of the film in the one direction of the film.

18. The shoe upper according to claim 14, wherein the film is at least partly exposed on an outer surface side of the upper body.

19. The shoe upper according to claim 14, wherein the heat shrinkage rate in the one direction of the film in the state of being attached to the region differs from the heat shrinkage rate in another direction of the film, which is different from the one direction of the film in the state of being attached to the region.

20. The shoe upper according to claim 14, wherein the heat shrinkage rate of the film in the state of being attached to the region in a width direction of the shoe upper is larger than the heat shrinkage rate of the film in the state of being attached to the region in a longitudinal direction of the shoe upper.

* * * * *